US009986784B2

(12) United States Patent
Downard

(10) Patent No.: US 9,986,784 B2
(45) Date of Patent: Jun. 5, 2018

(54) FLEXIBLE FOREFOOT PROTECTION FOR INSOLES AND SHOES

(76) Inventor: Jeffrey Brian Downard, Flagstaff, AZ (US)

( * ) Notice: Subject to any disclaimer, the term of this patent is extended or adjusted under 35 U.S.C. 154(b) by 588 days.

(21) Appl. No.: 13/433,255

(22) Filed: Mar. 28, 2012

(65) Prior Publication Data

US 2012/0272548 A1 Nov. 1, 2012

Related U.S. Application Data

(60) Provisional application No. 61/465,973, filed on Mar. 28, 2011.

(51) Int. Cl.

| | |
|---|---|
| ***A43B 23/00*** | (2006.01) |
| ***A43B 13/38*** | (2006.01) |
| ***A43B 5/00*** | (2006.01) |
| ***A43B 7/14*** | (2006.01) |
| ***A43B 7/26*** | (2006.01) |
| ***A43B 13/14*** | (2006.01) |

(52) U.S. Cl.

CPC ..... *A43B 5/003* (2013.01); *A43B 5/002* (2013.01); *A43B 7/145* (2013.01); *A43B 7/26* (2013.01); *A43B 13/141* (2013.01); *A43B 13/38* (2013.01)

(58) Field of Classification Search

CPC ..... A43B 13/38; A43B 13/141; A43B 5/002; A43B 5/003; A43B 7/145; A43B 7/26

USPC ..... 36/43, 44, 71, 113, 114, 103

See application file for complete search history.

(56) References Cited

U.S. PATENT DOCUMENTS

| | | | | | |
|---|---|---|---|---|---|
| 1,030,085 | A * | 6/1912 | Hale | A43B 3/126 | 36/11.5 |
| 2,205,091 | A * | 6/1940 | Geffner | A43B 3/101 | 36/101 |
| 2,224,590 | A * | 12/1940 | Boivin | A43B 7/06 | 36/3 B |
| 3,013,564 | A * | 12/1961 | Levey | 36/170 | |
| 3,084,695 | A * | 4/1963 | O'Donnell | A43B 7/142 | 36/174 |
| 3,967,390 | A * | 7/1976 | Anfruns | A43B 7/26 | 2/239 |
| 4,651,354 | A * | 3/1987 | Petrey | A41B 11/004 | 2/239 |
| 4,813,162 | A * | 3/1989 | Harris | A43B 3/108 | 36/11.5 |
| 5,774,898 | A * | 7/1998 | Malpee | A41B 11/004 | 2/22 |

(Continued)

*Primary Examiner* — Jila M Mohandesi

(74) *Attorney, Agent, or Firm* — Invention To Patent Services; Alex Hobson

(57) ABSTRACT

An invention pertaining to footwear is described, including a flexible protection plate, an insole, and a shoe with three forefoot pads and three toe compartments. The sections of the protection plate are hinged or separated to allow a greater degree of independent movement of the three main groups of muscles and bones in the forefoot in response to varying walking, hiking and running terrain. A separate insole is described that incorporates the forefoot protection plate and that can be inserted into and removed from footwear in order to provide additional protection as needed. A shoe including outersole, midsole and upper, are also described in which the forward portion is divided into three toe compartments that are configured to allow independent articulation of corresponding individual toes and/or pairs of toes inserted in the footwear.

18 Claims, 7 Drawing Sheets

(56) References Cited

U.S. PATENT DOCUMENTS

| | | | | |
|---|---|---|---|---|
| 5,913,592 | A * | 6/1999 | Moore | 36/8.1 |
| 6,412,194 | B1 * | 7/2002 | Carlson | A43B 7/141 36/154 |
| 7,082,703 | B2 * | 8/2006 | Greene et al. | 36/89 |
| 7,140,130 | B2 * | 11/2006 | Brooks | A43B 7/1415 36/145 |
| 7,168,190 | B1 * | 1/2007 | Gillespie | A43B 3/24 36/102 |
| 7,594,344 | B2 * | 9/2009 | Mizrahi | A43B 1/0045 36/101 |
| 7,707,747 | B2 * | 5/2010 | Nawachi et al. | 36/94 |
| 7,805,860 | B2 * | 10/2010 | Fliri | A43B 1/10 2/239 |
| 7,908,768 | B2 * | 3/2011 | Cheskin | A43B 7/141 36/144 |
| 7,971,374 | B2 * | 7/2011 | Hernandez | 36/94 |
| 8,453,346 | B2 * | 6/2013 | Steszyn | A43B 7/142 36/146 |
| 2008/0271340 | A1 * | 11/2008 | Grisoni | A43B 7/142 36/43 |
| 2010/0095552 | A1 * | 4/2010 | Cheskin | A43B 7/141 36/44 |
| 2010/0205831 | A1 * | 8/2010 | Cheskin | A43B 1/0009 36/44 |

* cited by examiner

FLEXIBLE FOREFOOT PROTECTION FOR INSOLES AND SHOES

CROSS REFERENCE TO RELATED APPLICATIONS

This application claims the benefit of priority to U.S. provisional patent application no. 61/465,973, files on Mar. 28, 2011.

TECHNICAL FIELD OF INVENTION

The invention concerns footwear designed for walking, hiking and running on uneven terrain such as trails. It covers a flexible rock protection plate that can be incorporated into removable insoles or directly into the construction of the midsole and outersole of shoes having protective plates along with a shoe that is constructed with three toe compartments and three protective pads. The forefoot protection plate, the insole, and the shoe with three toe compartments and three forefoot protective midsole and outer-sole pads are each designed to allow for an optimal balance of protection from injury while also maintaining flexibility and increased haptic response and proprioceptive sensitivity by the wearer.

BACKGROUND OF INVENTION

Toe movement and the coordination of the parts of the forefoot are essential factors in balance and in the efficient movement of the body. See, for example, "Kick Off Your Shoes and Run Awhile", Christopher McDougall, NY Times, 23 Jun. 2005; "Is Less More, Runner's World", Bob Parks, November 2010. The ability of a wearer to coordinate the different parts of the forefoot, along with the toes, the mid-foot and the heel are dramatically affected by shoes manufactured according to different designs. Many walking, hiking and running shoes are specifically designed and manufactured for use on uneven surfaces such as trails. These trail specific shoes often have thick and sturdy outer-soles, mid-soles, and "rock" pads in order to provide good protection from injury due to contact with rocks and roots. One downside of the typical design for trail specific shoes is that the materials used to provide increased protection from injury also dramatically decrease the overall sensitivity and response of the foot when the user is making contact with the ground. One reason is that the shoes doe not have much flexibility from side to side to allow the users to feel the ground with the different parts of the forefoot.

Recently, walking, hiking and running shoes have been designed and manufactured to provide greater flexibility upon the ground play important roles in walking, jogging, running, etc., and in providing and maintaining a person's bodily balance. One downside of these more "minimalist" shoes is that they do not provide as much protection for the forefoot from injury to the nerves, muscles and bones and other parts of the foot due to contact with objects such as rocks and roots on trails.

An apt description of conventional footwear is provided in U.S. Pat. No. 7,805,860. We draw on that description in the next four paragraphs. Conventional shoes generally include a sole portion and an upper formed above the sole and attached to a periphery thereof. The sole is shaped to underlie the bottom of a wearer's foot from the heel area through the arch, ball of the foot, up to and even beyond the tips of the toes. The upper extends over the sole to delimit a cavity that receives the foot.

A portion of the upper extends over the toe area of the sole to form a toe-cap at the front portion of the shoe. When the shoe is worn, the toes extend into the toe-cap and lie adjacent to one another. In this way, the foot rests upon a thick sole the bottom of which is generally flat for providing even contact with the ground. That is, when the shoe is at rest, the sole is disposed flush against the ground. When the conventional shoe is worn, the entire front toe-cap portion acts as a single unit. The movement of the toe-cap portion is generally limited to a pivoting action about the of the foot. That is, despite the various movements of the five toes disposed therein, the toe-cap portion moves as a single unit in only one direction at a time.

In this way, the conventional shoe can limit the natural movements of the toes and thus effect the overall operation and performance of the foot. Additionally, the toe-cap portion limits, and, in a number of respects, restricts, the wearer's ability to spread his/her toes within the toe cap portion. This can lead to significant discomfort of the wearer. This discomfort is compounded when the toes are crowded into the toe-cap portion. Moreover, the thick sole of a conventional shoe isolates the natural contouring and curvature of the foot from the ground, thus minimizing the foot's haptic sensations with respect to the ground. This can cause a general disassociation between a person and the ground resulting the development of improper foot and/or toe action while walking, running, etc. and can be generally disadvantageous with respect to the person's balance, agility, and overall foot health.

Attempts have been made to provide footwear having individual toe compartments that encapsulate each toe separately. See, for example, U.S. Pat. Nos. 3,967,390, 4,651,354, 5,774,898 and 7,805,860. While these designs for footwear provide some degree of freedom of movement for each of the toes, they each suffer from three drawbacks. First, it is difficult to insert the foot into the shoe. It can be time consuming and frustrating for a wearer to get a proper alignment between the compartments and the toes and to overcome the friction of the fabric and sole against each toe. Second, some wearers have found that it is uncomfortable to have the two smallest toes in separate compartments. These two toes, in particular, have a very limited range of lateral motion with respect to one another. Third, the individual toes—and especially the smallest toe—are prone to snag on objects such as loose carpets or power cords or to hit such objects as the legs of chairs, rocks and roots. Given the weakness of the bones in the smaller toes, this puts wearers at a risk of injury.

Footwear has been constructed having protective plates and pads for the forefoot. These plates and pads provide protection against bruising and other forms of injury from gravel, rocks, roots and other similar objects, and have often been employed in shoes designed for trail running virtually all of these shoes are designed with a single toe-cap. The typical construction of protective pads tends to treat the entire forefoot as a single functional unit in that it often provides a unitary plate that tends to deaden the sensitivity and response of the forefoot. Herein, proprioceptive sensitivity is used to mean the sense of response relating to internal muscular and connective sensitivity to the many forces involved with different kinds of exercise, while "haptic response" is used to mean a tactile sense of response relating particularly to the sense of touch associated with the feet and lower legs with respect to the ground/surface. Some efforts have been made to design protective pads and cushions that allow for increased movement as well as proprioceptive sensitivity and haptic response. See, for example, U.S. Pat. No. 5,384,973. These shoes do not, however, provide independence of movement and sensitivity for the ball, the middle section and the lateral section of the forefoot, which often serve as three functional units of the forefoot. Each of these three areas of the forefoot have unique roles in helping to maintain balance and in providing propulsion when walking, running, etc.

Footwear designed for running on smooth roads and footwear that provides a minimal amount of cushioning and support, such as the New Balance Minimus Trail and the Vibram FiveFingers Bikila, are currently being manufactured and used for the purpose of trail running wearers have complained that these kinds of shoes do not provide adequate protection from rocks, roots and even small pebbles. Removable insole inserts have been constructed to provide multiple layers of foam and gel pads for cushioning, and structured layers of foam for support. See, for example, US Patent Numbers 2010/0095552 A1, Ser. No. 12/668,983, Ser. No. 11/833,067, U.S. Pat. No. 7,140,130. Current construction of insoles does not provide for extra protection of the forefoot from impacts on rocks and similar objects while also providing flexibility in the protective plate. We address this problem with the construction of flexible protective forefoot plates that are incorporated directly into the insoles. The insoles can be inserted by wearers into foot cavity of shoes and removed at a later time—thereby giving wearers the option of running in shoes with or without forefoot protective plates.

BRIEF DESCRIPTION OF THE FIGURES

In the attached figures, like elements are numbered alike.

KEY TO THE FIGURES

Figure 1:
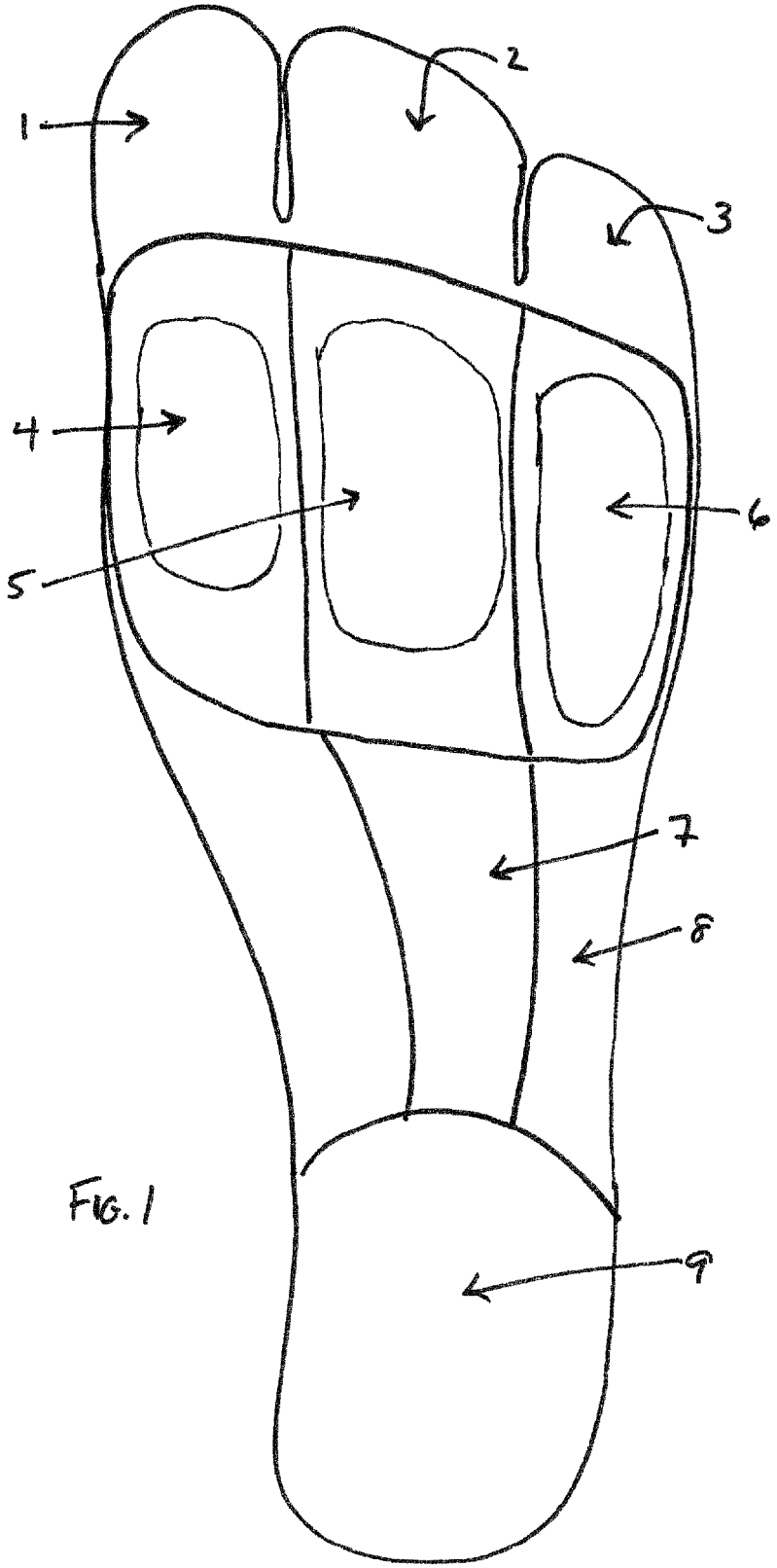
FIG. 1 shows a bottom plan of the footwear showing the three toe compartments and the approximate location of three protective plates for the forefoot according to the present invention.
Figure 2:
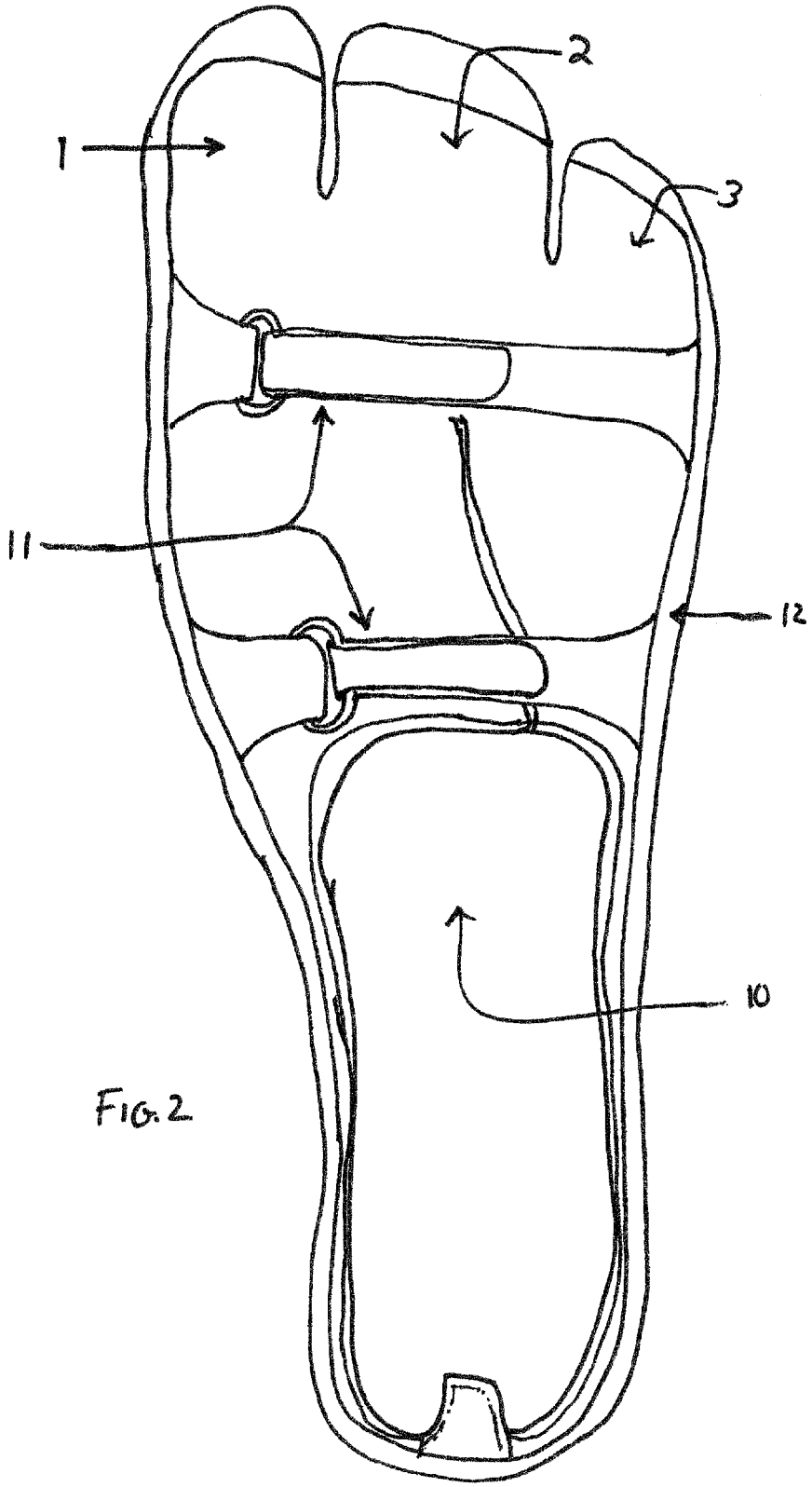
FIG. 2 shows a top plan of the footwear showing three toe compartments according to the invention.
Figure 3:
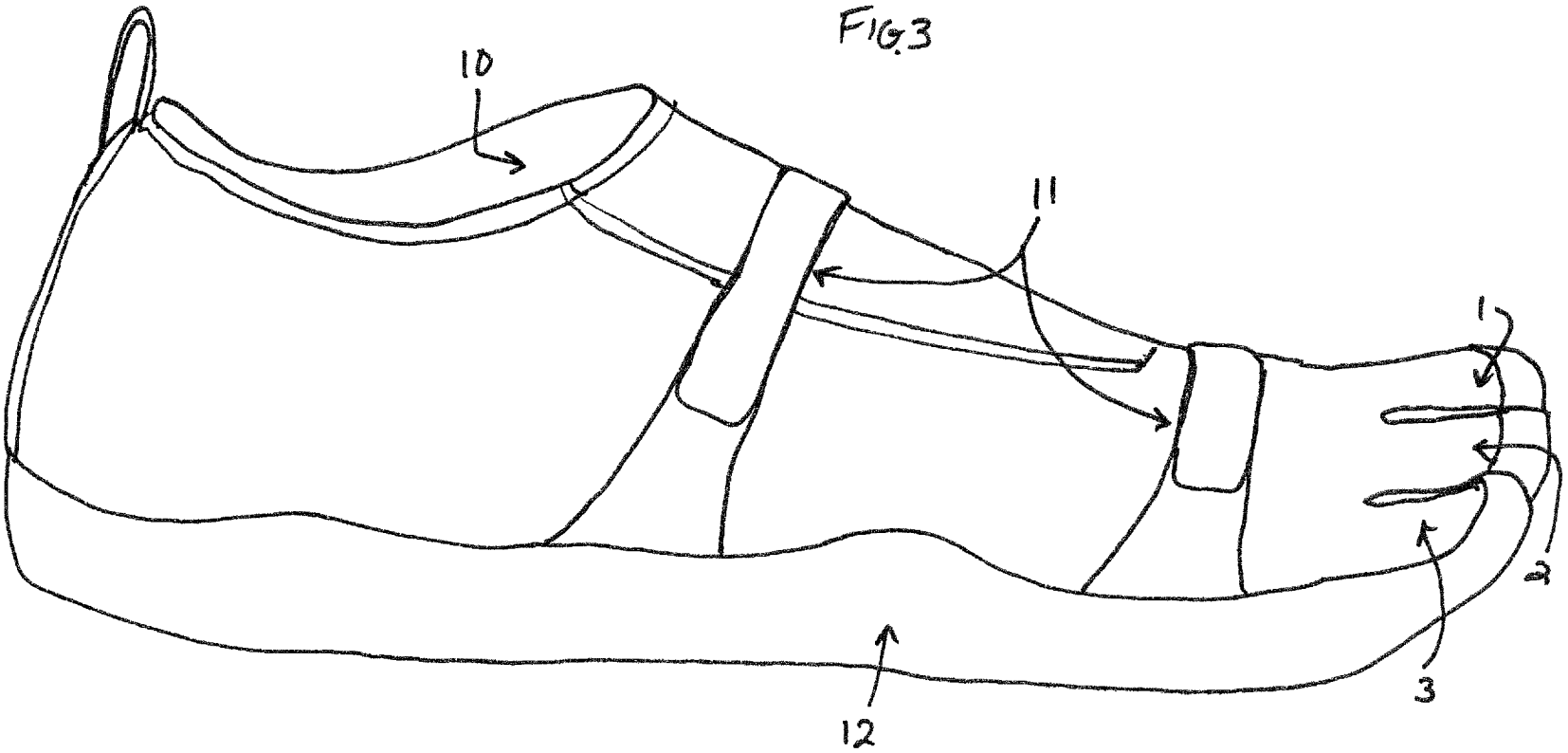
FIG. 3 shows a side elevation view thereof.
Figure 4:
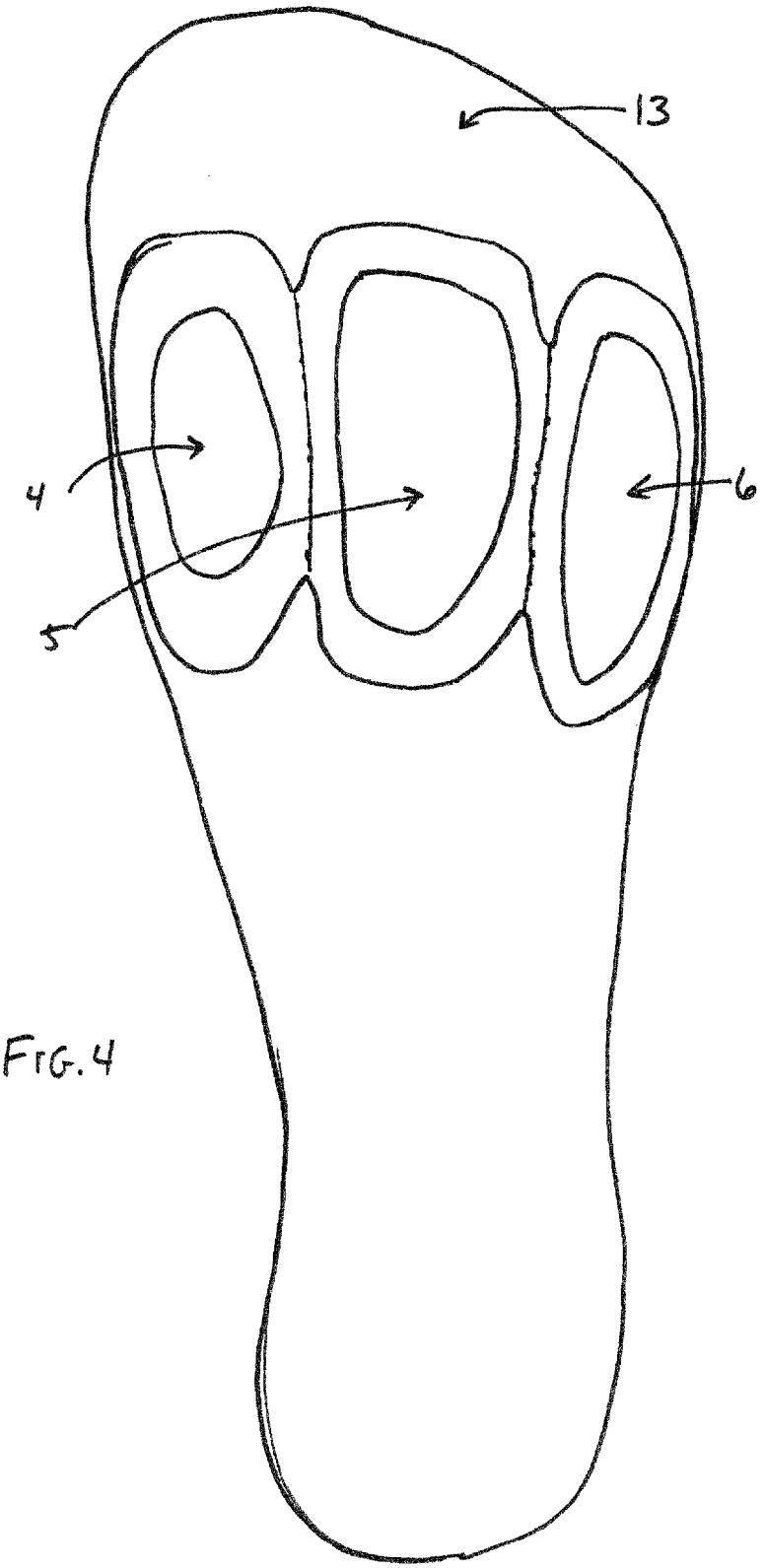
FIG. 4 shows a bottom plan of the footwear with three relatively independent forefoot protective plates in a shoe with a single toe box.
Figure 5:
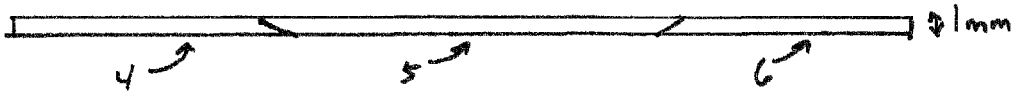
FIG. 5 shows a cross section of a forefoot protective plate that is completely divided into three separate pieces allowing for relative independence movement of each plate.
Figure 6:
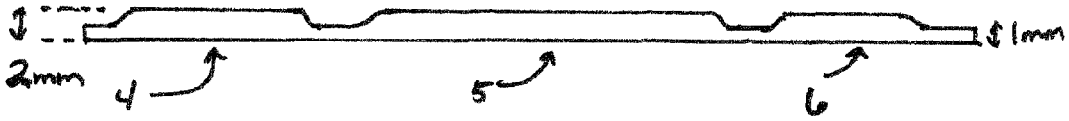
FIG. 6 shows a cross section of a single forefoot protective plate that is divided into three sections corresponding to the ball, middle portion and lateral portion of the foot by varying the thickness of the plate to allow for relative independence movement of each plate as the shoe bends to fit the varying contour of the ground.
Figure 7:
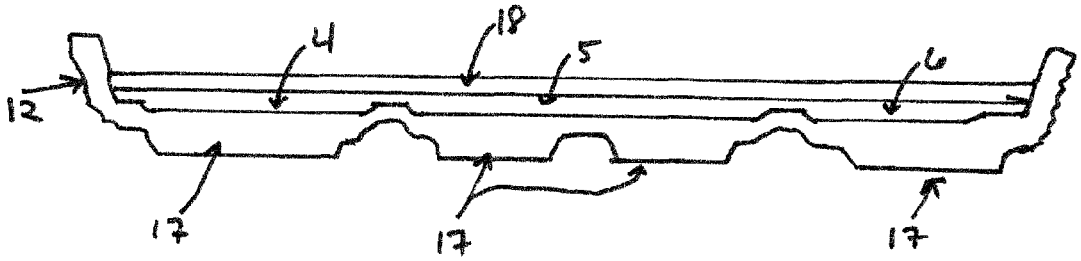
FIG. 7 shows a cross section of a forefoot protective together with the foam mid-sole and an outsole.
Figure 8:
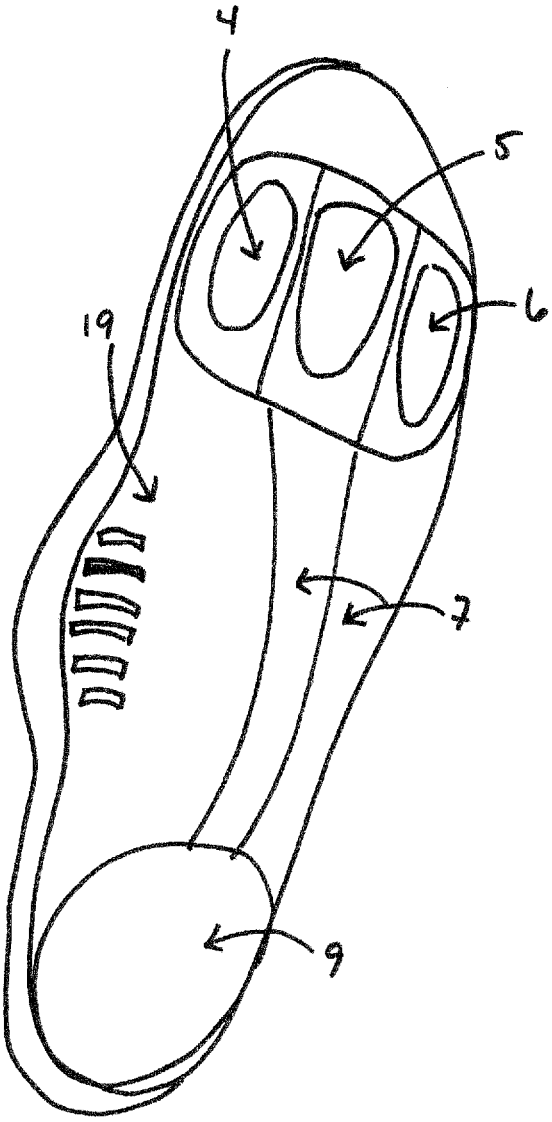
FIG. 8 shows a perspective bottom view of removable insoles with forefoot protective plates.
Figure 9:
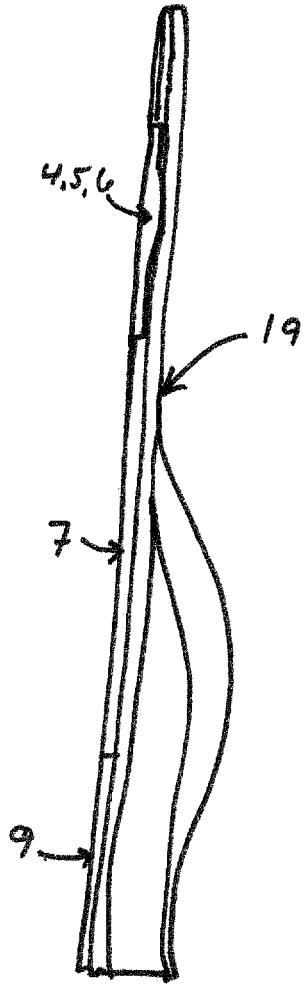
FIG. 9 shows a side view of the removable insoles with forefoot protective plates.
Figure 10:
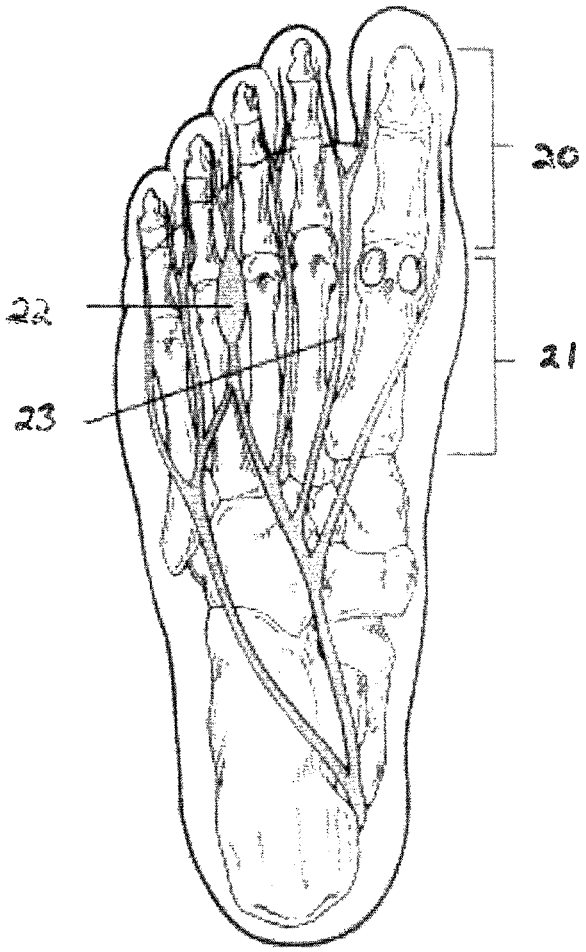
FIG. 10 shows a bottom view of the major bones and nerves in the foot.

1. Toe compartment for large toe;
2. Toe compartment for middle two toes;
3. Toe compartment for lateral two toes;
4. Forefoot protective plate for ball of forefoot;
5. Forefoot protective plate for middle section of forefoot;
6. Forefoot protective plate for lateral section of forefoot;
7. Middle section of mid-foot protective plate;
8. Lateral section of mid-foot protective plate;
9. Heel section of protective plate;
10. Cavity for foot;
11. One iteration of adjustable straps to hold footwear securely to foot;
12. Out-sole;
13. Single toe cap as found on a typical footwear;
14. Forefoot protective plate contoured to the shape and size of the large phalange and metatarsal comprising part of the ball of the forefoot, and designed to be hinged or entirely separate from the other forefoot protective pads;
15. Forefoot protective plate contoured to the shape and size of the middle two phalanges and metatarsals comprising part of the ball of the forefoot, and designed to be hinged entirely separate from the other forefoot protective pads;
16. Forefoot protective plate contoured to the shape and size of the lateral two phalanges and metatarsals comprising part of the ball of the forefoot, and designed to be hinged or entirely separate from the other forefoot protective pads;
17. Large outsole lugs typical for trail running shoes;
18. Foam midsole;
19. Insole constructed from EVA, Polyurethane or other foam, cork or other similar material;
20. Toes and phalange bones;
21. Metatarsal bones;
22. Neuroma between middle and lateral pairs of phalanges and metatarsals;
23. Normal nerve between phalange and metatarsal of the large toe and the middle pair of metatarsals.

SUMMARY OF THE INVENTION

The invention is for a flexible forefoot protection plate, an insole that incorporates the protection plate, and a shoe with three forefoot pads and three toe compartments. The "rock" protection plate, as it is often called in the running shoe industry, is comprised of three main sections. The sections of the protection plate are hinged or separated to allow a greater degree of independent movement of the three main groups of muscles and bones in the forefoot in response to varying walking, hiking and running terrain. The flexibility of the forefoot plate provides a balance between optimal protection at the same time that it allows increased proprioceptive sensitivity and haptic response as compared to what is currently available in the manufacture of shoes having a single protection plate in the forefoot of the shoe. The partially or fully independent sections of the protection plate correspond to the three main areas in the forefoot (i.e., the ball, the middle and the lateral sections). In current manufacture of trail running shoes, protective forefoot pads are typically incorporated into or between the outer sole and the midsole of the shoe.

The invention includes an insole that incorporates the forefoot protection plate and that can be inserted into and removed from footwear in order to provide additional protection as needed. It also includes a shoe that is comprised of an outer-sole, midsole and upper in which the forward portion is divided into three toe compartments and the midsole and outer-sole are comprised of three pads that are designed to strike a balance between increased independence of movement of the three groups of toes along with ease of putting the shoes on the feet as compared to shoes with five toe compartments. The shoe may include the forefoot protection plate between the midsole and outersole.

DETAILED DESCRIPTION OF THE INVENTION

These problems and deficiencies of the prior art are overcome or alleviated by the invention that provides novel and non-obvious "rock" protection plate for the forefoot, along with insole, mid-sole, outersole and toe-box devices for increased protection, freedom of movement, sensitivity and response. The invention provides three protective pads or plates comprised of various combinations of outsole, harder plastic (typically nylon, TPU, rubber or similar material) protective rock plate and foam midsole. These components may be formed separately or together. The three forefoot plates provide extra protection for the three groups of bones, muscles, ligaments and tendons in the forefoot. These groups correspond to the ball of the foot, the middle group, and the lateral group. In some iterations of the footwear, the three protective pads and plates are combined with the three separate compartments for the toes. This arrangement has the advantage of increasing the independence of movement, sensitivity and response of the three sets of toes and three related parts of the forefoot and the coordination between each of the toes and parts of the forefoot.

The invention provides for separate insoles that incorporate protective plates for the forefoot, mid-foot, and/or heel. Insoles for running and walking footwear are currently manufactured and sold separately for shoes. The invention provides the novelty of incorporating one or more protective rock plates into the manufacture of the insole. In addition to incorporating forefoot plates designed to provide semi or complete independence for the three parts of the forefoot, we also claim invention of insoles with a single forefoot, mid-foot, and/or heel protective plate. These insoles can be easily installed or removed, thereby giving wearers of footwear designed for running on relatively smooth surfaces and minimalist footwear the ability to add additional protection against injury from rocks by inserting the insoles with protective plates and then removing the insoles at a later time when running on a smooth surface such as a road and the extra protection is no longer needed. This represents a significant increase in utility of insole construction. The insoles are shaped to fit shoes with a single toe-cap or to fit shoes with two, three, four or five separate toe compartments.

The invention additionally provides a footwear including a sole, an upper, and a arrangement of straps, laces or other devices configured to secure the footwear to the foot of a wearer, where the sole and the upper delimit three toe compartments configured to receive, retain, and allow articulation of corresponding individual toes and pairs of toes inserted in the footwear. These three toe compartments allow a high degree of movement, sensitivity and response by the large toe, along with the middle and the lateral pairs of toes. The sole may include contouring and curvature which corresponds to the shape of the foot, and where the sole, midsole and upper are disposed to provide an enhanced range of movement, proprioceptive sensitivity and haptic response to the wearer.

In one paradigm case, the sole is comprised of an exterior sole with lugs for improved traction made of a rubber material of approximately 2-15 mm in thickness, a protective plate of a harder nylon TPU, plastic, rubber or similar material that varies between 1-3 mm in thickness, and a foam midsole of 2-20 mm in thickness. The layers needed in a given kind of shoe and the particular thickness of each layer depend upon the intended use of the footwear. The width, length, and shape of the forefoot protective plate or plates may vary depending upon the intended purpose of the footwear and other factors including the size and shape of the foot of the intended wearer. Shoes designed for running on padded tracks will typically have fewer layers or less material in the sole, while those designed for use on rough trails will have more protection and padding. The arrangement of the protective plates and pads can be made with variable thicknesses of the harder plastic, rubber or other similar material so that the thicker portions will be located directly below the most sensitive bones in the forefoot, and the thinner portions on the borders between the three areas to allow for relative independence of movement, sensitivity and response. In other iterations, the three pads may be partially or completely separated from one another in the process of constructing the shoe.

These features and advantages of the apparatus and method will be appreciated and understood by those skilled in the art from the drawings and detailed description.

What is claimed is the following:

1. A shoe comprising:

a) an outsole;

b) an upper coupled to the outsole and extending over the outsole;

c) an insert configured for placement within the shoe and comprising:

i) a protective plate comprising:

a forefoot protective plate located over a forefoot portion of the shoe and comprising:

a ball section consisting of a hard plastic;

a middle section consisting of a hard plastic; and a lateral section consisting of a hard plastic;

wherein the ball section is configured under a ball portion of a foot when said foot is inserted into said shoe;

wherein the middle section is located between the ball section and the lateral section;

wherein the forefoot protective plate is a single piece of hard plastic and comprises a thinner portion between the ball section and middle section to provide independent movement of the ball section and middle sections;

wherein the single piece of hard plastic forefoot protective plate comprises a thinner portion between the middle section and lateral section to provide independent movement of the middle section and lateral section; and wherein the insert is a removable insert for insertion and removal from the shoe;

d) an insole comprising a foam layer;

wherein the forefoot protective plate is configured between the outsole and the insole.

2. The shoe of claim 1, wherein the protective plate comprises a mid-foot protective plate consisting of a hard plastic.

3. The shoe of claim 2, wherein the mid-foot protective plate and forefoot protective plate are separate pieces to provide independent movement of the forefoot protective plate and the mid-foot protective plate.

4. The shoe of claim 2, wherein the mid-foot protective plate and the forefoot protective plate are a single piece of hard plastic and wherein the mid-foot protective plate is connected to the forefoot protective plate by a thinner portion between the mid-foot protective plate and the forefoot protective plate to provide independent movement of the forefoot protective plate and the mid-foot protective plate.

5. The shoe of claim 1, wherein the insert further comprises a heel protective plate consisting of a hard plastic.

6. The shoe of claim 1, wherein the insert further comprises a heel protective plate consisting of a hard plastic and a mid-foot protective plate consisting of a hard plastic and wherein the heel protective plate and the mid-foot protective plate are separate pieces to provide independent movement of the mid-foot protective plate and the heel protective plate.

7. The shoe of claim 1, wherein the insert further comprises a heel protective plate consisting of a hard plastic and a mid-foot protective plate consisting of a hard plastic and wherein the heel protective plate and the mid-foot protective plate are connected by a thinner portion between the mid-foot protective plate and the heel protective plate to provide independent movement of the mid-foot protective plate and the heel protective plate and wherein the forefoot protective plate, the mid-foot protective plate and the heel protective plate are a single piece of hard plastic.

8. The shoe of claim 7, wherein the mid-foot protective plate is connected to the forefoot protective plate by a thinner portion between the mid-foot protective plate and the forefoot protective plate to provide independent movement of the mid-foot protective plate and the forefoot protective plate.

9. The shoe of claim 1, wherein the insert further comprises a heel protective plate consisting of a hard plastic and a mid-foot protective plate consisting of a hard plastic and wherein the mid-foot protective plate, forefoot protective plate and heel protective plates are attached to said insert.

10. The shoe of claim 9, wherein the protective plate is attached to said insole.

11. The shoe of claim 1, wherein the forefoot protective plate has a thickness between 1 and 3 mm.

12. The shoe of claim 1, wherein the removable forefoot protective plate is configured to underlay only a forefoot of said foot when said foot is inserted into the shoe and does not extend under an arch or heel of said foot.

13. The shoe of claim 1, wherein the removable forefoot protective plate is in the shape of the insole.

14. The shoe of claim 1, wherein the protection plate is detachably attached to the foam insole.

15. A shoe comprising:

a) an outsole;

b) an upper coupled to the outsole and extend over the outsole;

c) an insole configured for placement within the shoe and comprising:

i) a protective plate comprising:

a forefoot protective plate located over a forefoot portion of the shoe and comprising:

a ball section consisting of a hard plastic;

a middle section consisting of a hard plastic; and a lateral section consisting of a hard plastic;

wherein the middle section is located between the ball section and the lateral section;

wherein the forefoot protective plate is a single piece of hard plastic and comprises a thinner portion between the ball section and the middle section and between the middle section and the lateral section to provide independent movement of the ball section, middle section and lateral section;

ii) a foam layer;

wherein the forefoot protective plate is configured between the outsole and the foam layer.

16. The shoe of claim 15, wherein each of the ball section, middle section and lateral section have a thickness of between 1 and 3 mm.

17. The shoe of claim 15, wherein the foam layer is detachably attached to the protective plate.

18. A shoe comprising:

a) an outsole;

b) an upper coupled to the outsole and extending over the outsole;

c) an insert configured for placement within the shoe and comprising:

i) a protective plate comprising:

a forefoot protective plate located over a forefoot portion of the shoe and comprising:

a ball section consisting of a hard plastic;

a middle section consisting of a hard plastic; and a lateral section consisting of a hard plastic;

wherein the ball section is configured under a ball portion of a foot when said foot is inserted into said shoe;

wherein the middle section is located between the ball section and the lateral section;

wherein the forefoot protective plate is a single piece of hard plastic and comprises a thin portion having a thickness of 1 to 3 mm between the ball section and middle section to provide independent movement of the ball section and middle sections;

wherein the forefoot protective plate is a single piece of hard plastic and comprises a thin portion having a thickness of 1 to 3 mm between the middle section and lateral section to provide independent movement of the middle section and lateral section; and wherein the insert is a removable insert for insertion and removal from the shoe;

d) an insole comprising a foam layer;

wherein the forefoot protective plate is configured between the outsole and the insole.

* * * * *